US007578317B2

(12) United States Patent
Levine et al.

(10) Patent No.: US 7,578,317 B2
(45) Date of Patent: Aug. 25, 2009

(54) HIGH-SPEED SPUN-BOND PRODUCTION OF NON-WOVEN FABRICS

(75) Inventors: Mark J. Levine, Hendersonville, TN (US); David Graham, Kaukauna, WI (US); Bill Houfek, Menasha, WI (US); Thomas L. Israel, Appleton, WI (US)

(73) Assignee: Albany International Corp., Albany, NY (US)

( * ) Notice: Subject to any disclaimer, the term of this patent is extended or adjusted under 35 U.S.C. 154(b) by 928 days.

(21) Appl. No.: 10/280,865

(22) Filed: Oct. 25, 2002

(65) Prior Publication Data

US 2003/0164199 A1 Sep. 4, 2003

Related U.S. Application Data

(60) Provisional application No. 60/336,897, filed on Oct. 29, 2001.

(51) Int. Cl.
*D21F 1/10* (2006.01)
*D21F 7/08* (2006.01)
*D03D 23/00* (2006.01)

(52) U.S. Cl. ..... 139/383 A; 139/383 AA; 139/383 R; 162/358.2; 442/205

(58) Field of Classification Search ..... 139/383 R, 139/383 A, 383 AA; 162/903, 358.2; 442/203, 442/205

See application file for complete search history.

(56) References Cited

U.S. PATENT DOCUMENTS 3,851,681 A 12/1974 Egan
4,351,874 A 9/1982 Kirby
4,359,069 A 11/1982 Hahn
4,403,632 A * 9/1983 Romanski et al. ..... 139/383 A
4,438,789 A * 3/1984 MacBean ..... 139/383 AA
4,457,968 A 7/1984 Harvey
5,164,249 A * 11/1992 Tyler et al. ..... 442/207
5,601,120 A * 2/1997 Kuckart et al. ..... 139/383 AA
5,814,349 A 9/1998 Geus et al.
5,865,219 A * 2/1999 Lee et al. ..... 139/383 A
6,410,138 B2 * 6/2002 Mleziva et al. ..... 428/369
6,709,996 B2 * 3/2004 Mleziva et al. ..... 442/353
6,769,535 B2 * 8/2004 Zilker et al. ..... 198/847
6,790,796 B2 * 9/2004 Smith et al. ..... 442/189
6,796,010 B2 * 9/2004 Noelle ..... 28/104
6,799,957 B2 * 10/2004 Allen ..... 425/66

OTHER PUBLICATIONS

International Search Report issued by European Patent Office for corresponding international application PCT/US02/34302, mailed Mar. 6, 2003.

* cited by examiner

*Primary Examiner*—Bobby H Muromoto, Jr.
(74) *Attorney, Agent, or Firm*—Frommer Lawrence & Haug LLP; Ronald R. Santucci

(57) ABSTRACT

In combination with a high-speed spun-bond apparatus, rather than using a circulating sieve belt for collecting the stretched filaments and forming the web, a fabric having a 4-shed double layer with support shute weave design is used. This fabric is commonly referred to as a 4B weave and 4B weave with stuffer in center. In general, the fabric has a permeability ranging from 400 to 800 cfm with a woven or pin seam where the seam permeability and caliper varies only slightly with respect to the rest of the fabric.

14 Claims, 5 Drawing Sheets

110

4 B Weave With Stuffer in Center

Section Cut Parrallel To Warp

Pattern

| 4' | 3' | 2' | 1' | | |
|---|---|---|---|---|---|
| | | | X | 1" | Top |
| X | X | | X | 2" | Bottom |
| X | | | X | 3" | Middle |
| X | | | | 4" | Top |
| X | | X | X | 5" | Bottom |
| X | | X | | 6" | Middle |
| | | X | | 7" | Top |
| X | X | X | | 8" | Bottom |
| | X | X | | 9" | Middle |
| | X | | | 10" | Top |
| | X | X | X | 11" | Bottom |
| | X | | X | 12" | Middle |

HIGH-SPEED SPUN-BOND PRODUCTION OF NON-WOVEN FABRICS

CROSS-REFERENCE TO RELATED APPLICATION

This application is based upon and claims the benefit of U.S. Provisional Patent Application Ser. No. 60/336,897 filed Oct. 29, 2001 entitled "High-Speed Spun-Bond Production of Non-Woven Fabrics", the disclosure of which is incorporated herein by reference.

FIELD OF THE INVENTION

The present invention is directed towards a high-speed spun-bond forming apparatus in combination with a forming fabric for the production of spun-bond webs or fabrics.

BACKGROUND OF THE INVENTION

There presently exists apparatus for the production of spun-bond webs or fabrics formed from filaments or fibers typically made from a thermoplastic resin. Such an apparatus is disclosed in U.S. Pat. No. 5,814,349 issued Sep. 29, 1998, the disclosure of which is incorporated herein by reference. Such apparatus typically includes a spinneret for producing a curtain of strands and a process-air blower for blowing process air onto the curtain of strands for cooling same to form thermoplastic filaments. The thermoplastic filaments are then typically, aerodynamically entrained by the process air for aerodynamic stretching of the themoplastic filaments which are then, after passing through a diffuser, deposited upon a continuously circulating sieve belt for collecting the interentangled filaments and forming a web thereon. The web or fabric, so formed, is then subject to further processing.

Apparatus of this type, particularly for high-speed spun-bond web production are currently available from Reifenhäuser GmbH Co. Maschinenfabrik, Spicher Strabe D-53839 Troisdort, Germany and sold under the name Reicofil®. The latest generation of such high-speed spun-bond lines is referred to as the Reicofil® 3 type system.

Another manufacturer of such equipment is Nordson Corporation, 28601 Clemens Road, Westlake, Ohio 44145.

Such equipment endeavors to operate at higher and higher speeds. Most of the high-speed technology involves less than 2 denier filament base webs, with the highest speed spinning relative to less than 1 denier, termed micro denier webs. The high-speed spinning involves high velocity, small diameter fibers that will naturally exhibit bounce at impact, due to the high-speed, and bleed through the sieve belt or fabric, due to their small size relative to fabric open area. Also, fabrics need to allow for the removal of excessive quantities of air in "sealed" type arrangements as disclosed in the aforesaid patent. In such a situation, accordingly it is desirable to have a fabric with high permeability, low bleed, and sufficient topography to avoid uncontrollable fiber "splashing" during deposition. Also, new high-speed system place the diffuser close to the fabric which increases both the magnitude and quantity of high velocity vertical impingement of fiber onto the fabric.

Current fabrics or belts used in high-speed spun-bond manufacturing lines are a compromise between good hold down and excessive bleed through. For example, while a fabric may provide for good hold down of the web, it may do so at the expense of fiber penetration and bleed through into the fabric or belt. Alternatively, while a fabric may limit bleed through of deposited filaments, it does so at the expense of web hold down.

Accordingly, there is a need in the high spun-bond production of a web to provide for a fabric which improves the formation of a web at higher speeds whilst having good hold down of the web and limited fiber bleed through.

SUMMARY OF THE INVENTION

It is therefore a principal object of the invention to provide for, in combination with a high-speed spun-bonding apparatus, a fabric which has improved characteristics in areas of web hold down and the limiting of fiber bleed through.

It is a further object of the invention to provide in such combination a fabric that reduces fiber splash back in high-speed operation.

A yet further object of the invention is to improve web uniformity as well as fiber blending/penetration between layers of the web.

A yet further object of the invention is to provide for high-speed spun-bond production which avoids or minimizes seam marks on the formed web.

The present invention provides for such objectives in high-speed spun-bond production of a web through the use of a machine of the type disclosed in the aforementioned patent, machines manufactured by the aforesaid manufacturer or other types of spun-bonding machines suitable for the purpose. In combination with such an apparatus, rather than using a circulating sieve belt for collecting the stretched filaments and forming the web, a fabric having a 4-shed double layer with support shute weave design is used. This fabric is commonly referred to as a 4B weave and 4B weave with stuffer in center. In general, the fabric has a permeability ranging from 400 to 800 cfm with a woven or pin seam where the seam permeability and caliper varies only slightly with respect to the rest of the fabric. The use of such a fabric in the spun-bonding process provides for high fiber hold down and sheet uniformity which is the result of a coarse surface topography which limits fiber bounce or splash. Minimal fiber bleed through occurs as a result of the absence of straight paths for air flow through the fabric.

Also, the use of the pin seam arrangement provides for a high degree of uniformity between the seam and the fabric body so as to avoid seam marks on the web.

BRIEF DESCRIPTION OF THE DRAWINGS

Thus by the present invention, its objects and advantages will be realized, the description of which should be taken in conjunction with the drawings wherein.

DETAILED DESCRIPTION OF THE PREFERRED EMBODIMENT

Figure 1:
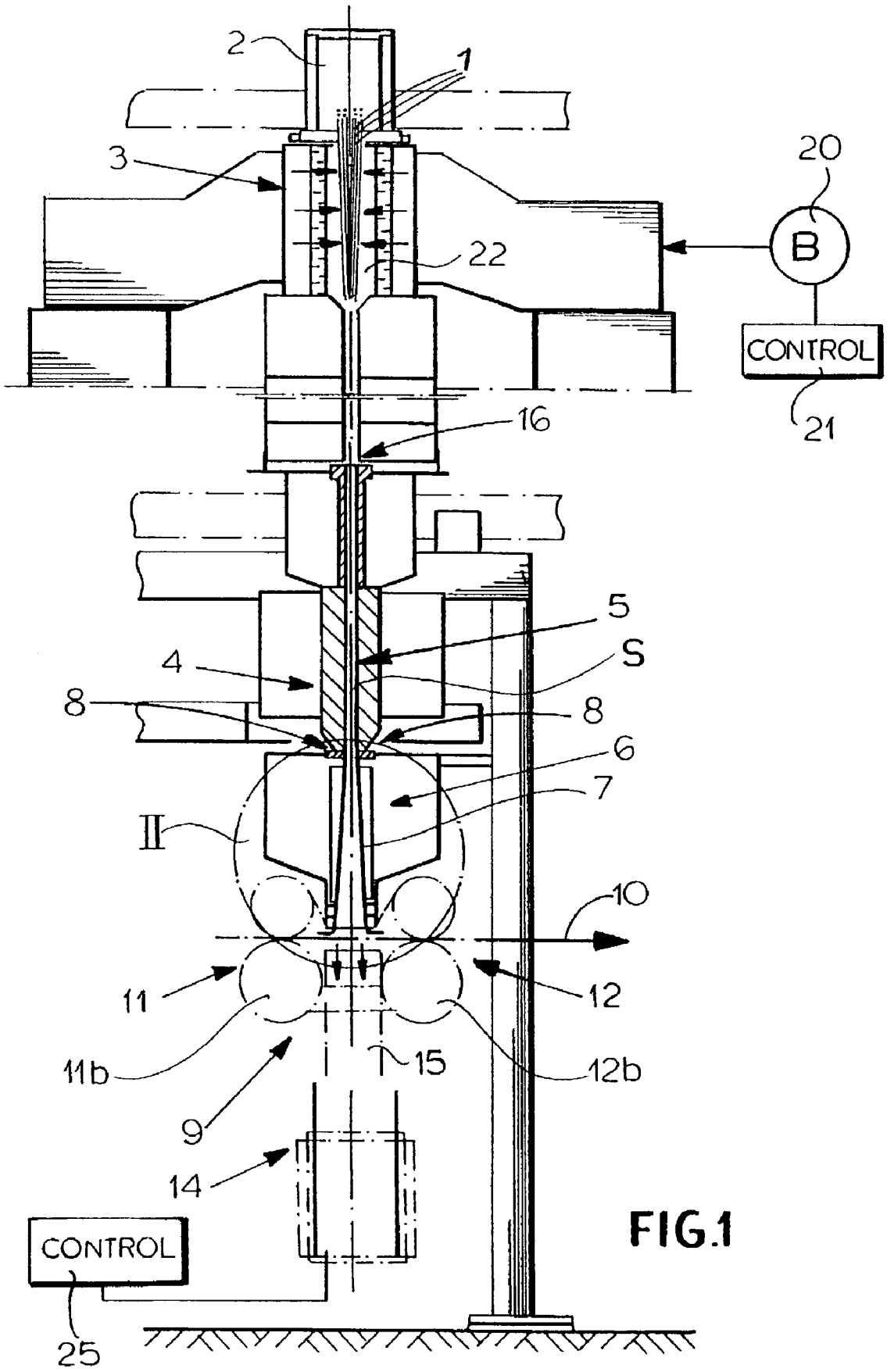
FIGS. 1 and 2 are diagram views of an apparatus for the production of a spun-bond web as disclosed and described in U.S. Pat. No. 5,814,349.
Figure 2:
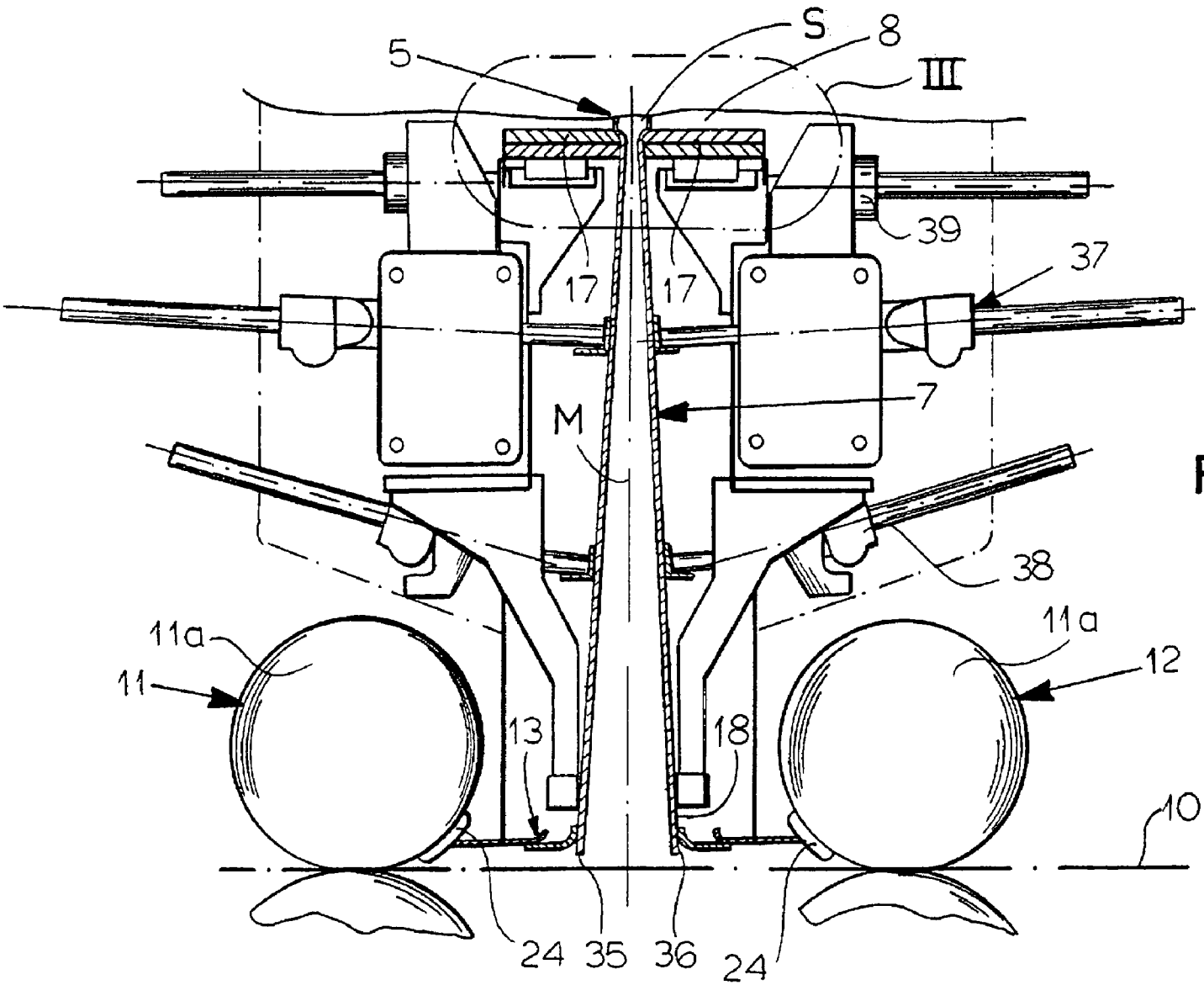

Turning now more particularly to the drawings, FIGS. 1 and 2 show generally diagrammatic drawings of an apparatus for high-speed spun-bond production for a non-woven web of material. For purposes of this discussion, the term web is being used to designate the non-woven fabric which is being produced by the high-speed spun-bond apparatus. This is to be distinguished from the sieve belt or continuous endless belt on which the web is formed as referenced to in the aforesaid patent. The fabric as disclosed herein equates to the aforesaid belt.

In this regard, FIGS. 1 and 2 are shown as merely representative of a spun-bond apparatus and should not be considered exclusive to the present invention. Rather, the combination of a spun bonding apparatus with the fabric as described herein is that which the present invention is directed. Accordingly, the apparatus set forth in FIGS. 1 and 2 will not be discussed, rather reference is made to the discussion set forth in said patent.

Figure 3:
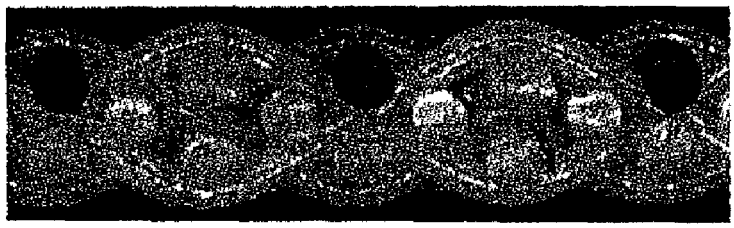
FIG. 3 is a cross-sectional view of a fabric taken parallel to warp for use in combination with an apparatus for spun-bond web production.

In FIG. 3 there is a side sectional view taken parallel to the warp direction of the fabric 110. Such a fabric 110 would be used in place of belt 10 shown in FIGS. 1 and 2 of said patent.

The fabric envisioned is a woven mesh fabric or "wire" which is specifically designed to provide high fiber support, good sheet hold down, and low fiber bleed through on high-speed spun-bond manufacturing lines. What is shown in FIG. 3 is a 4-shed double layer fabric with a support shute weave design. The diameters of the warp yarns range from 0.20 mm-0.80 mm. The diameter of the weft yarns range from 0.20 mm-1.00 mm.

Figure 5:
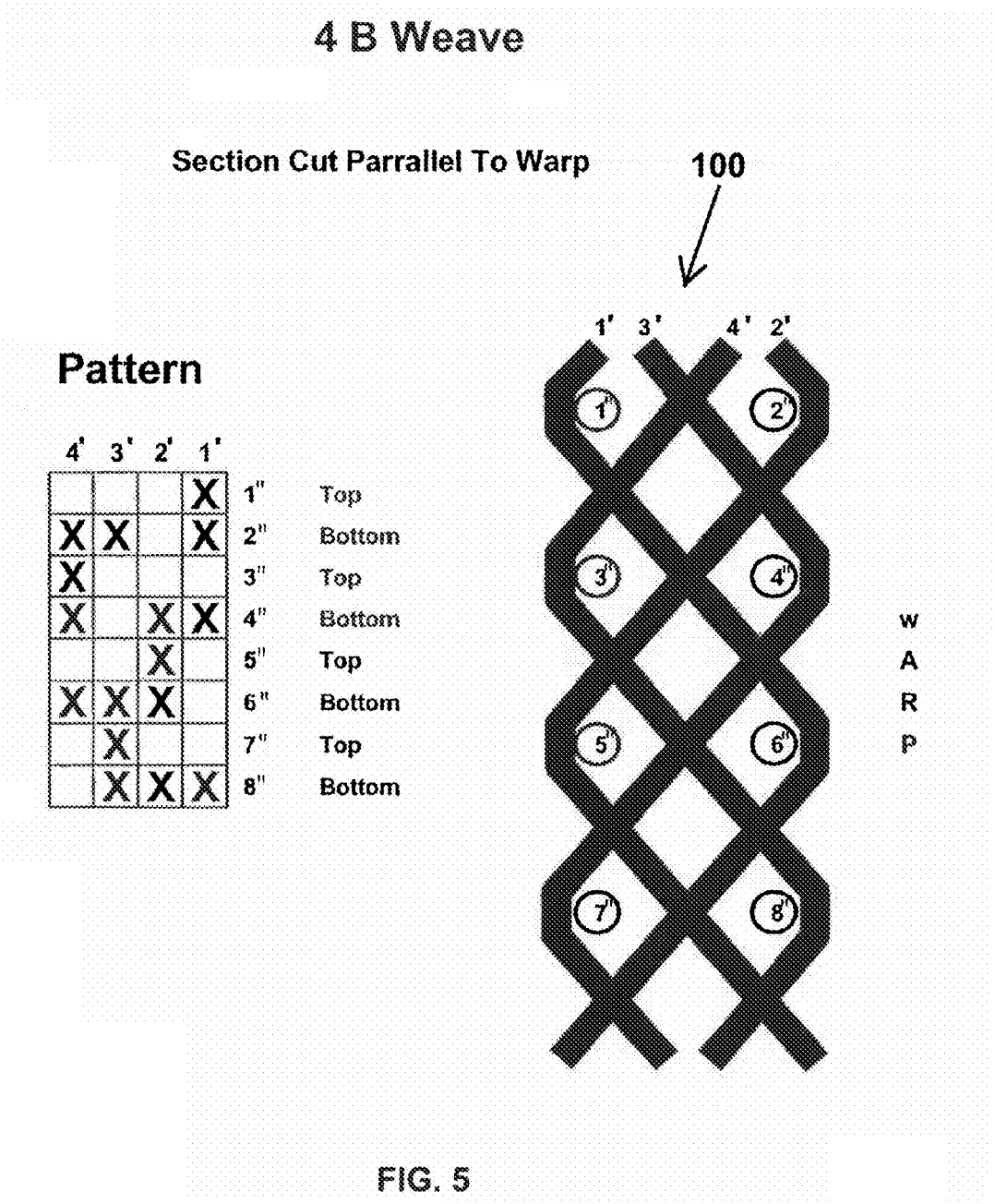
FIG. 5 shows the weave pattern of a 4B weave.

The weave pattern of the fabric 100 is typically referred to as a 4B weave as shown in FIG. 5 wherein the schematic cross-sectional view is that parallel to warp. The warp yarns are indicated as 1', 2', 3', and 4', and the weft yarns are indicated as 1", 2", 3", 4", 5", 6", 7", and 8", according to one exemplary embodiment of the invention. The weft yarns may, for example, form two separate layers as shown in FIG. 5. As seen in FIG. 5, warp yarn 1' weaves over weft yarns 1", 2", and 4", and under weft yarns 3", 5", 6", and 7" before it weaves over weft yarn 8" within one repeat of a weave pattern. Warp yarn 2' weaves under weft yarns 1", 2", and 3" before it weaves over weft yarns 4", 5", and 6", under weft yarn 7" and over weft yarn 8" within one repeat of a weave pattern. Warp yarn 3' weaves under weft yarn 1", over weft yarn 2" and under weft yarns 3", 4", and 5" before it weaves over weft yarns 6", 7", and 8" within one repeat of a weave pattern. Ware yarn 4' weaves under weft yarn 1" before it weaves over weft yarns 2", 3", and 4", under weft yarn 5", over weft yarn 6" and under weft yarns 6" and 7" within one repeat of a weave pattern. It is to be noted that in such fabrics, the weave pattern is repeated in the warp direction as well as in the weft direction until a desired or full width and length of the fabric is produced.

Figure 6:
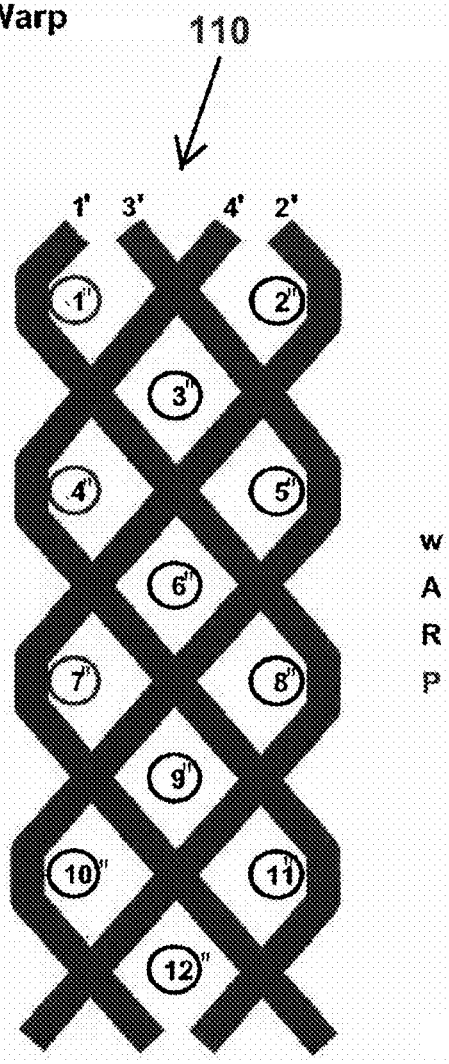
FIG. 6 shows the weave pattern of a 4B weave with stuffer in the center.

The weave pattern shown in FIG. 6 is referred to as a 4B weave with stuffer in center and would correspond to that shown in FIG. 3. In this exemplary embodiment, a schematic cross-sectional view of fabric 110 is shown, where the warp yarns are indicated as 1', 2', 3', and 4', the weft yarns are indicated as 1 ", 2", 4", 5", 7", 8", 10", and 11", and the stuffer yarns in the center are indicated as 3", 6", 9", and 12", for example. The weft yarns may, for example, form two separate layers, which may be separated by stuffer yarns in the center as shown in FIG. 6. As shown in FIG. 6, warn yarn 1' weaves over weft yarns 1", 2", and 5" and stuffer yarn 3", and under weft yarn 4" before it weaves under weft yarns 7", 8", and 10" and stuffer yarns 6" and 9", and over weft yarn 11" and stuffer yarn 12" within one repeat of a weave pattern. Warp yarn 2' weaves under weft yarns 1", 2", and 4" and stuffer yarn 3" before it weaves over weft yarns 5", 7", and 8" and stuffer yarns 6" and 9", under weft yarn 10", over weft yarn 11" and under stuffer yarn 12" within one repeat of a weave pattern. Warp yarn 3' weaves under weft yarn 1", over weft yarn 2" and under weft yarns 4", 5", and 7" and stuffer yarns 3" and 6" before it weaves over weft yarns 8", 10", and 11" and stuffer yarns 9" and 12" within one repeat of a weave pattern. Warp yarn 4' weaves under weft yarn 1" before it weaves over weft yarns 2", 4", and 5" and stuffer yarns 3" and 6", under weft yarn 7", over weft yarn 8" and under weft yarns 10" and 11" and stuffer yarns 9" and 12" within one repeat of a weave pattern. It is to be noted that in such fabrics, the weave pattern is repeated in the warp direction as well as in the weft direction until a desired or full width and length of the fabric is produced. It should be noted that the fabric may be woven from yarns, fibers, threads, strands or the like, and that the term "yarns" as used herein is meant to collectively refer to all such elements.

The permeability of the fabric ranges from 400 to 800 cfm, preferably from 500 to 600 cfm. Materials of construction of the yarns or fibers are typically polyester based (polyethyleneterephthalate or "PET," polybutlylene terephthalate, or "PBT," poly [1,4 dimethylol] cyclohehane terephthalate or "PCTA" or other material suitable for purpose) along with conductive strands such as PET, polyarnides or "PA," Stainless Steel or "SS," Invar or other fibers having static dissipation characteristics. Polyarnide, Polyphenylene Sulfide, polyetheretherketone or "PEEK" or other commercially available fibers may be used in this construction depending upon temperature or chemicals that may be additionally present in processing.

The fabric should be durable. Conditions may vary and the selection of materials used in the fabric's construction should obviously take the environment into consideration. Note, however, that fabrics having this type of weave have found applications in the harsh conditions of papermaking, particularly in the dryer section of papermaking machines.

Figure 4:
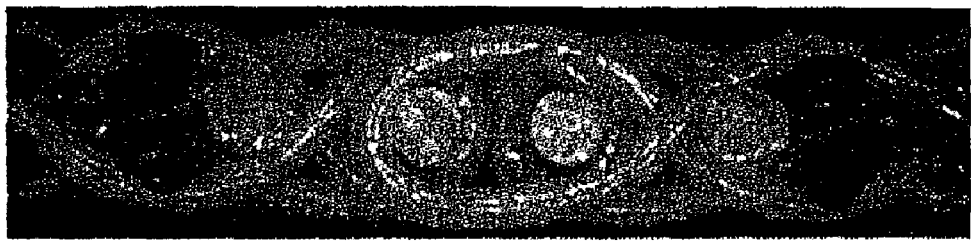
FIG. 4 is a cross-sectional view of the fabric of FIG. 3 showing a double loop pin seam.

The fabric 110 may have a woven seam, or preferably a pin seam arrangement along with its attendant advantages. In this regard, shown in FIG. 4, is a pin seam, preferably, a low mark double loop double pin seam is constructed by inserting 15%-60% larger diameter strands prior to and within the seam loops so as to ensure permeability varies no more than 25 cfm and seam caliper varies no more than 3% from the respective parameters measured in the body of the fabric.

The aforedescribed fabric 110, when used in a high-speed spun-bond apparatus provides for a high degree of fiber hold down and web uniformity as a result of a coarse surface topography which minimizes fiber reflective bounce or splash at surface impact during high-speed spinning. This superior hold down eliminates roll wraps which are prevalent at high-speeds (greater than 300 mpm, approximately 1000 fpm). Web uniformity improvements include both visual fiber surface distribution uniformity as well as fiber blending/penetration between layers on multibeam machines (i.e. machines designated SSS, SMS, SSMMS, in the industry).

The fabric 110 also provides for minimal fiber bleed through the fabric as a result of no straight through (perpendicular to the surface plane) air flow which allows for more consistent sheet formation and higher manufacturing efficiencies/yield by minimizing vacuum box/slot build up over time. Vacuum box build up over time causes a decrease in vacuum pressure affecting web formation, quality and yield. Also, due to the seaming arrangement, there are little or no seam marks on the formed web due to the high degree of uniformity between the seam and fabric body for pin seamed fabrics. Seam marks are typically a problem with very coarse designs used in such spun bonding applications.

Thus it can be seen that through the use of the afore-described fabric, in combination with a spun-bond apparatus superior operation is achieved over fabrics heretofore utilized in such applications.

Modifications to the present invention would be obvious to those of ordinary skill in the art in the view of this disclosure, but would not bring the invention so modified beyond the scope of the appended claims.

What is claimed is:

1. Apparatus for production of spun-bond webs comprising:

a fabric for collecting stretched filaments intended to form a spun-bond web, wherein said fabric is woven such that air flow through said fabric is prevented in a direction substantially perpendicular to the surface plane of said fabric with warp yarns and weft yarns having a diameter in the range of 0.20 mm to 0.80 mm, wherein said fabric has a 4-shed double layer with support shute weave design in order to be woven in a 4B pattern with a stuffer yarn in the center, wherein each of the warp yarns weave over a single weft yarn on the surface of the fabric within the 4B pattern, and wherein said fabric has a permeability in the range of 400 cfm to 800 cfm.

2. The apparatus as claimed in claim 1, wherein said fabric includes yarns that include one or more materials selected from the group consisting of polyethyleneterephthalate, polybutlylene terephthalate, poly[1,4 dimethylol]cyclohehane terephthalate, polyarnide, polyphenylene sulfide and polyetheretherketone.

3. The apparatus as claimed in claim 1, wherein said fabric includes one or more conductive yarns.

4. The apparatus as claimed in claim 3, wherein said one or more conductive yarns includes one or more materials selected from the group consisting of polyethyleneterephthalate, polyarnides, stainless steel and Invar.

5. The apparatus as claimed in claim 1, wherein said fabric includes a pin seam.

6. The apparatus as claimed in claim 5, wherein said pin seam is a low mark double loop double pin seam.

7. The apparatus as claimed in claim 6, wherein said fabric includes warp yarns and weft yarns, and the weft yarns prior to and within the seam loops are larger than the other weft yarns by an amount in the range of 15% to 60%.

8. A method for forming a spun-bond web, the method comprising the steps of:

collecting stretched filaments that form said spun-bond web on a fabric in an apparatus for the formation of spun-bond webs, wherein said fabric is woven such that air flow through said fabric is prevented in a direction substantially perpendicular to the surface plane of said fabric with warp yarns and weft yarns having a diameter in the range of 0.20 mm to 0.80 mm, wherein said fabric has a 4-shed double layer with support shute weave design in order to be woven in a 4B pattern with a stuffer yarn in the center, wherein each of the wart yarns weave over a single weft yarn on the surface of the fabric within the 4B pattern, and wherein said fabric has a permeability in the range of 400 cfm to 800 cfm.

9. A method as claimed in claim 8, wherein said fabric includes yarns that include one or more materials selected from the group consisting of polyethyleneterephthalate, polybutlylene terephthalate, poly[1,4 dimethylol]cyclohehane terephthalate, polyarnide, polyphenylene sulfide and polyetheretherketone.

10. A method as claimed in claim 8, wherein said fabric includes one or more conductive yarns.

11. A method as claimed in claim 10, wherein said one or more conductive yarns includes one or more materials selected from the group consisting of polyethyleneterephthalate, polyarnides, stainless steel and Invar.

12. A method as claimed in claim 8, wherein said fabric includes a pin seam.

13. A method as claimed in claim 12, wherein said pin seam is a low mark double loop double pin seam.

14. A method as claimed in claim 13, wherein said fabric includes warp yarns and weft yarns, and the weft yarns prior to and within the seam loops are larger than the other weft yarns by an amount in the range of 15% to 60%.

* * * * *

UNITED STATES PATENT AND TRADEMARK OFFICE

CERTIFICATE OF CORRECTION

PATENT NO. : 7,578,317 B2
APPLICATION NO. : 10/280865
DATED : August 25, 2009
INVENTOR(S) : Levine et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 196 days.

Signed and Sealed this

Seventh Day of September, 2010

David J. Kappos

David J. Kappos
*Director of the United States Patent and Trademark Office*